US010801695B2

(12) United States Patent
Jiao et al.

(10) Patent No.: US 10,801,695 B2
(45) Date of Patent: Oct. 13, 2020

(54) LAMP

(71) Applicant: FLYING TECHNOLOGY CO., LTD., Shenzhen, Guangdong (CN)

(72) Inventors: Songling Jiao, Guangdong (CN); Bojian Peng, Guangdong (CN)

(73) Assignee: FLYING TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 16/310,070

(22) PCT Filed: May 17, 2017

(86) PCT No.: PCT/CN2017/084699
§ 371 (c)(1),
(2) Date: Mar. 18, 2019

(87) PCT Pub. No.: WO2017/215398
PCT Pub. Date: Dec. 21, 2017

(65) Prior Publication Data

US 2019/0264892 A1 Aug. 29, 2019

(30) Foreign Application Priority Data

Jun. 16, 2016 (CN) ..... 2016 1 0436018

(51) Int. Cl.
*F21V 7/00* (2006.01)
*F21V 7/24* (2018.01)
(Continued)

(52) U.S. Cl.
CPC ..... *F21V 7/0008* (2013.01); *F21V 7/005* (2013.01); *F21V 7/06* (2013.01); *F21V 7/08* (2013.01);
(Continued)

(58) Field of Classification Search
None
See application file for complete search history.

(56) References Cited

U.S. PATENT DOCUMENTS

2007/0103935 A1* 5/2007 Masuyama ..... F21V 7/08 362/612

FOREIGN PATENT DOCUMENTS

CN 105570774 A * 5/2016

* cited by examiner

*Primary Examiner* — Britt D Hanley
(74) *Attorney, Agent, or Firm* — Polsinelli PC

(57) ABSTRACT

Disclosed is a lamp. The lamp comprises a reflection hood (110), a light source assembly (120) and a reflection member (130). The reflection hood (110) is made of diffuse reflection material, is a curved face formed by the translation of an elliptic arc, and has a light emitting outlet (114), and an inner surface thereof is a reflection face (112). The light source assembly (120) is fixed to an end of the reflection face (112) and the included angle between a tangent line, at the point of intersection of a central light emitted therefrom and the reflection face (112), and the central light is 130° to 170°. The reflection member (130) is fixed to an end of the reflection face (112) and has a reflection wall (132) parallel to the central light. The central light is located between the reflection hood (110) and the reflection member (130). Some light emitted from the light source assembly (120) is reflected to the reflection face (112) by the reflection wall (132) and emitted from the light outlet (114) after being reflected by the reflection face (112); and other light is reflected by the reflection face (112) and emitted from the light emitting outlet (114).

18 Claims, 8 Drawing Sheets

(51) Int. Cl.

| | |
|---|---|
| ***F21V 7/08*** | (2006.01) |
| ***F21V 15/015*** | (2006.01) |
| ***F21V 7/06*** | (2006.01) |
| ***F21V 7/22*** | (2018.01) |
| ***F21V 29/89*** | (2015.01) |
| ***F21Y 103/10*** | (2016.01) |
| ***F21Y 115/10*** | (2016.01) |

(52) U.S. Cl.

CPC ..... *F21V 7/22* (2013.01); *F21V 7/24* (2018.02); *F21V 15/015* (2013.01); *F21V 29/89* (2015.01); *F21Y 2103/10* (2016.08); *F21Y 2115/10* (2016.08)

LAMP

CROSS REFERENCE TO RELATED APPLICATIONS

This application is a National Phase filing under 35 U.S.C. § 371 of PCT/CN2017/084699 filed on May 17, 2017, and claims priority to Chinese Patent Application No. CN 201610436018.5, entitled "LAMP" filed on Jun. 16, 2016. The entire contents of each application are hereby incorporated by reference in their entireties.

TECHNICAL FIELD

The present disclosure relates to a lamp.

BACKGROUND

Current panel lamps and integrated lamps for office lighting are side-type lighting or direct-type lighting with a low luminous efficiency and a high glare value, such that human eyes cannot adapt to light brightness, easily causing visual fatigue, thereby being not suitable for mass replacement. Accordingly, it is necessary to improve the quality of the illumination light and reduce the glare value while ensuring the luminous efficiency.

SUMMARY

According, it is necessary to provide a lamp having a reduced glare value.

A lamp includes:

a reflecting cover made of a diffuse reflecting material, the reflecting cover has a light exit opening, an inner surface of the reflecting cover is a reflecting surface, the reflecting surface is a curved surface formed by a translation of an elliptical curve;

a light source assembly fixed to an end portion of the reflecting surface, an angle between a tangent line at an intersection point where a central ray emitted by the light source assembly intersects the reflecting surface and the central ray is 130° to 170°; and a reflecting element fixed to the end portion of the reflecting surface, the reflecting element has a reflective wall parallel to the central ray, the central ray is positioned between the reflecting cover and the reflecting element, part of light emitted by the light source assembly is reflected by the reflective wall onto the reflecting surface, then reflected by the reflecting surface and emitted from the light exit opening, another part of the light is reflected by the reflecting surface and then emitted from the light exit opening.

BRIEF DESCRIPTION OF THE DRAWINGS

In order to more clearly explain the embodiments of the present disclosure or technical solutions in prior art, a brief description of the accompany drawings which need to be used in the explanation of the embodiments or prior art is provided. The drawings in the following description are merely some embodiments of the disclosure, and, for those with ordinary skills in the art, drawings of other embodiments may be obtained from these drawings without creative effort.

DETAILED DESCRIPTION OF THE EMBODIMENTS

Figure 1:
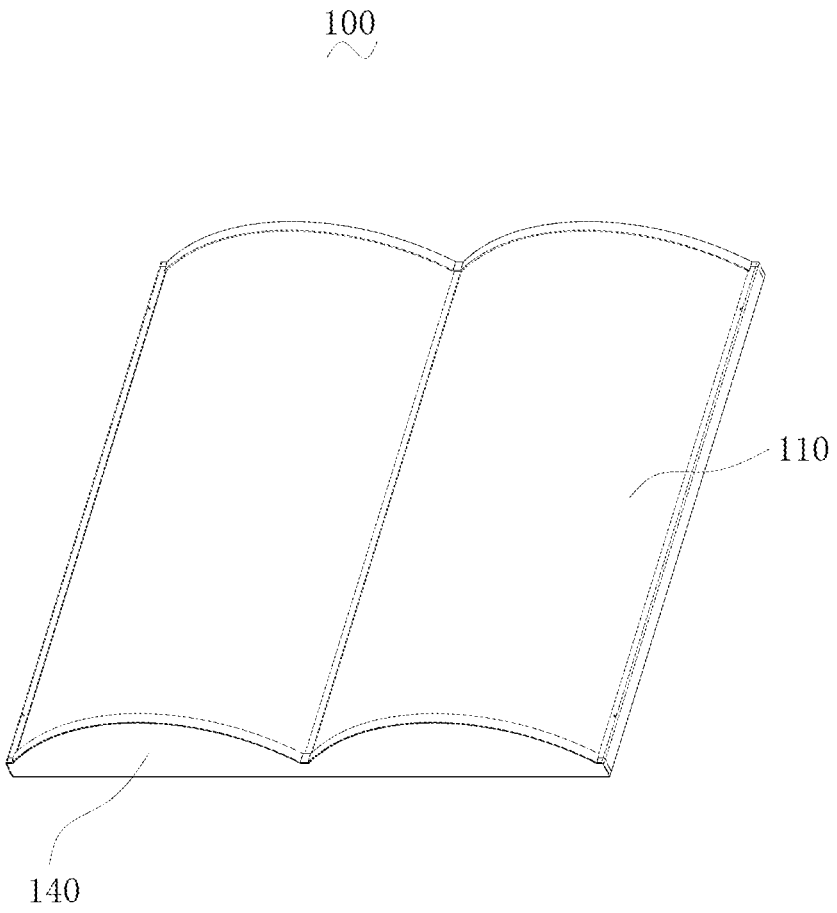
FIG. 1 is a schematic view of a lamp according to one embodiment.

Embodiments of the invention are described more fully hereinafter with reference to the accompanying drawings.

As shown in FIGS. 1 to 4, a lamp 100 according to an embodiment includes a reflecting cover 110, a light source assembly 120, and a reflecting element 130.

The reflecting cover 110 is made of a diffuse reflecting material. Specifically, the diffuse reflectivity of the reelecting cover 110 is greater than 93%, so as to reduce the energy loss of the reflecting cover 110 as much as possible, thereby increasing the light efficiency of the lamp 100.

Specifically, the diffuse reflecting material is a foamed plastic. Further, the diffuse reflecting material is a foamed PET, foamed polycarbonate, or Styrofoam. These materials have a higher rigidity and better strength if directly used for structural elements of the lamp 100, and can effectively reduce the weight of the lamp 100 when used for structural elements. The material of the reflecting cover 110 may be, for example, of the MCPET/MCPOLYCA material series of FURUKAWA ELECTRIC CO., LTD, and alternatively of the white optics White97™ series of Whiteoptics, Teijin Tetoron UF series of TEIJIN LIMITED or TORAY E series of Toray; Styrofoam materials of Teijin and Toray.

The diffuse reflecting material is not limited to these materials. In other embodiments, the diffuse reflecting material may also be an unexpanded polystyrene, unexpanded polycarbonate, unexpanded PET, or unexpanded polytetrafluoroethylene. For example, the polystyrene reflective material of Whiteoptics.

The light transmittance of the reflecting cover 110 is 2% to 3%, such that part of light can be transmitted through the reflecting cover 110, therefore the entire lamp 100 has a better appearance, and looks more exquisite.

An inner surface of the reflecting cover 110 is a reflecting surface 112. The reflecting surface 112 is a curved surface formed by a translation of an elliptical curve. The reflecting cover 110 has a light exit opening 114.

The specular reflectivity of the reflecting surface 112 of the reflecting cover 110 is less than 10%, such that light emitted by the lamp 100 is more dispersed, making the light emitted by the lamp 100 more uniform. Also, by having the specular reflectivity of the reflecting surface 112 less than 10%, the beads of the lamp 100 can be prevented from being seen from the reflecting surface 112.

Figure 5:
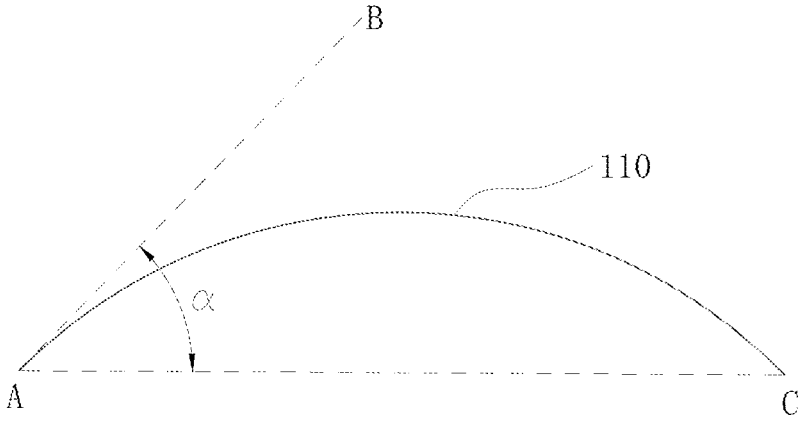
FIG. 5 is a schematic view of the reflecting cover of the lamp shown in FIG. 2.

Also referring to FIG. 5, further, an angle $\alpha$ between a tangent line AB at an end point of the elliptical curve of the reflecting surface 112 and a connection line AC between two end points of the elliptical curve is 30° to 60°, so as to better control the lighting angle of the lamp 100 and reduce the glare value.

It is to be understood that the reflecting surface 112 of the reflecting cover 110 is not limited to the shape, and in other embodiments, the reflecting surface 112 is a curved surface formed by a translation of a polyline. In this instance, the angle of the polyline is 60° to 120°.

Figure 6:
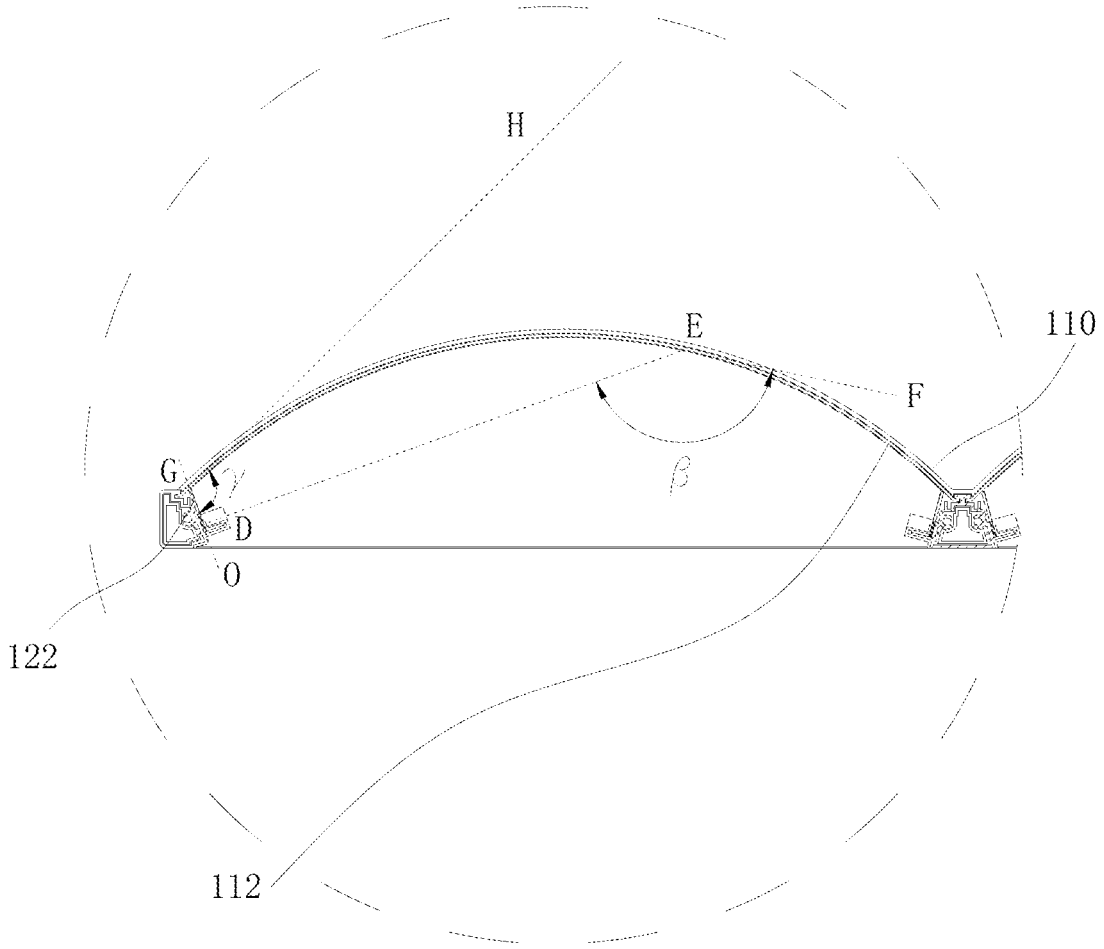
FIG. 6 is an enlarged view of a portion III of the lamp shown in FIG. 3.

Also referring to FIG. 6, a light source assembly 120 is fixed to an end portion of the elliptical curve of the reflecting surface 112 of the reflecting cover 110. An angle β between a tangent line EF at an intersection point E where a central ray DE emitted by the light source assembly 120 intersects the reflecting surface 112 and the central ray DE is 130° to 170°.

Figure 7:
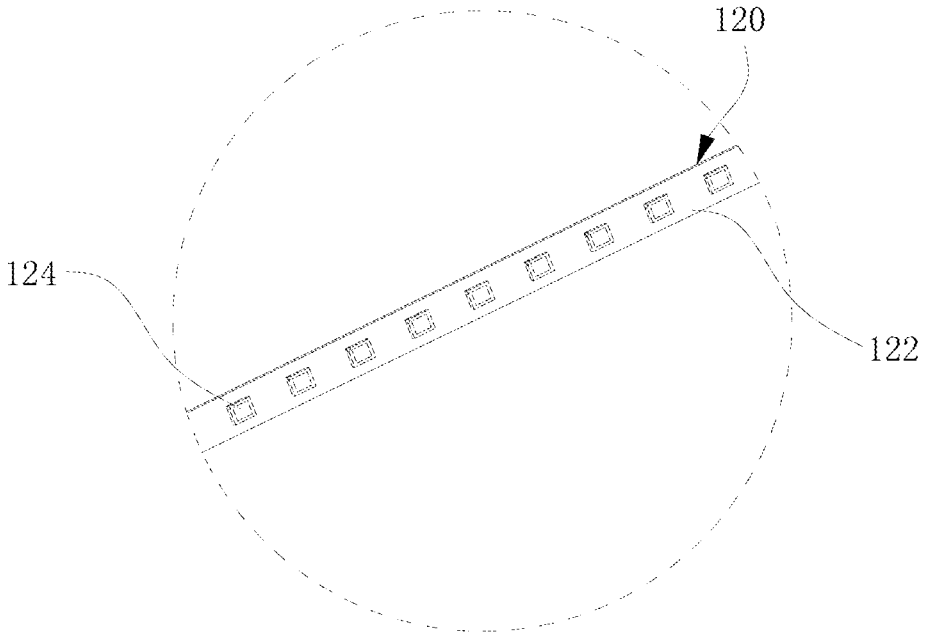
FIG. 7 is an enlarged view of a portion I of the lamp shown in FIG. 2.

Also referring to FIG. 7, specifically, the light source assembly 120 includes a substrate 122 and an LED light source 124.

The substrate 122 is a metal plate having good heat dissipation performance, such as an aluminum plate. The substrate 122 has a strip shape. The substrate 122 is fixed to the end portion of the elliptical curve of the reflecting surface 112 of the reflecting cover 110. An angle γ between a tangent line GH at an intersection point G where the substrate 122 intersects the reflecting surface 112 and a transverse direction GO of the substrate 122 is 100° to 120°. Further, the angle γ between the tangent line GH at the intersection point G where the substrate 122 intersects the reflecting surface 112 and the transverse direction GO of the substrate 122 is 114°.

The LED light source 124 is fixed on the substrate 122. Specifically, the LED light source 124 is adhered to the substrate 122. The central ray DE emitted by the LED light source 124 is perpendicular to the substrate 122.

Each reflecting cover 110 corresponds to two substrates 122, and two substrates 122 are fixed to both end portions of the elliptical curve of the reflecting surface 112 of the reflecting cover 110, respectively. Longitudinal directions of the two substrates 122 are both parallel to a translation direction of the elliptical curve. Each substrate 124 is provided with a plurality of LED light sources 124 arranged at intervals along the longitudinal of the substrate 124.

Figure 4:
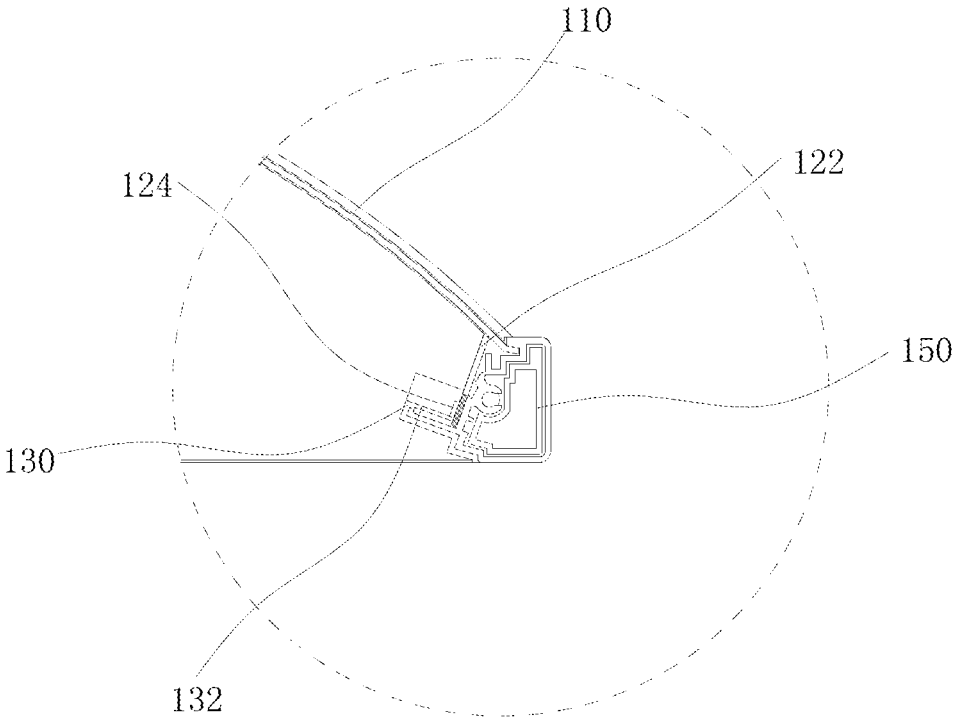
FIG. 4 is an enlarged view of a portion II of the lamp shown in FIG. 3.

Referring to FIG. 4, FIG. 6, and FIG. 7 again, the reflecting element 130 is fixed to the end portion of the elliptical curve of the reflecting surface 112 of the reflecting cover 110. The reflecting element 130 has a reflective wall 132. The reflective wall 132 is parallel to the central ray DE emitted by the light source assembly 120.

Figure 2:
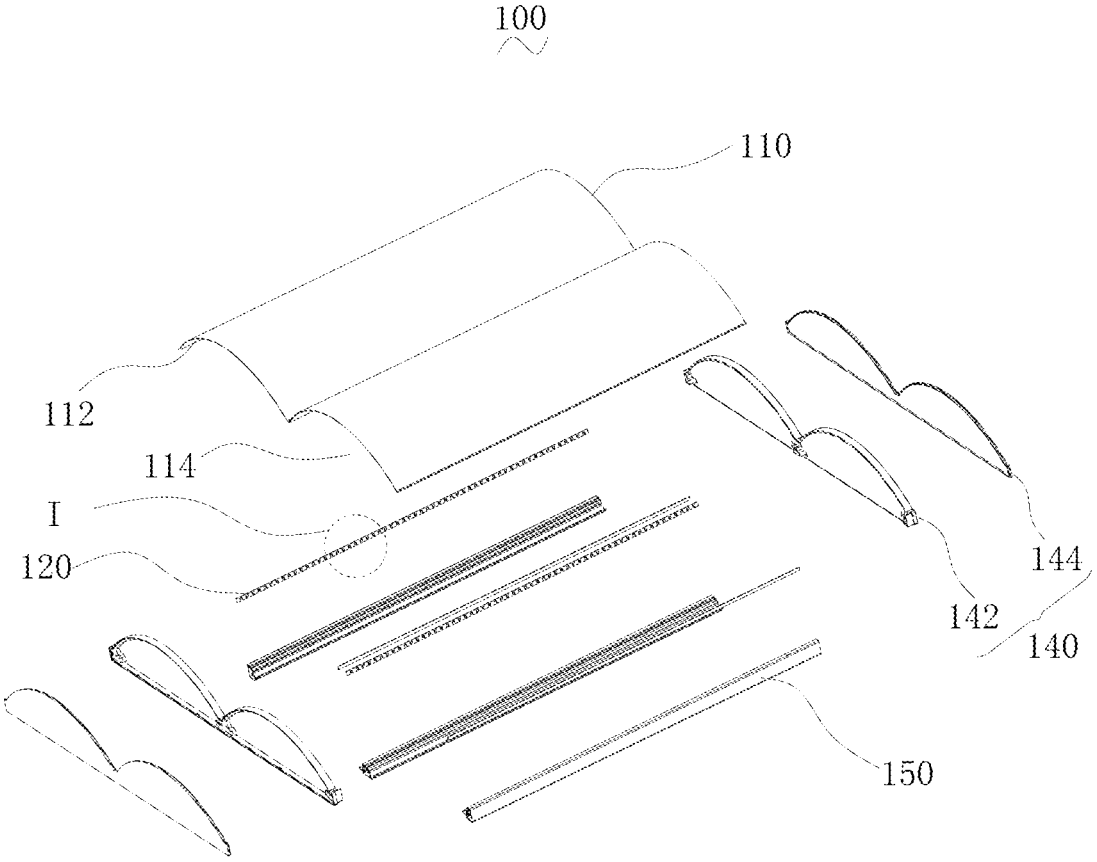
FIG. 2 is an exploded view of the lamp shown in FIG. 1.
Figure 3:
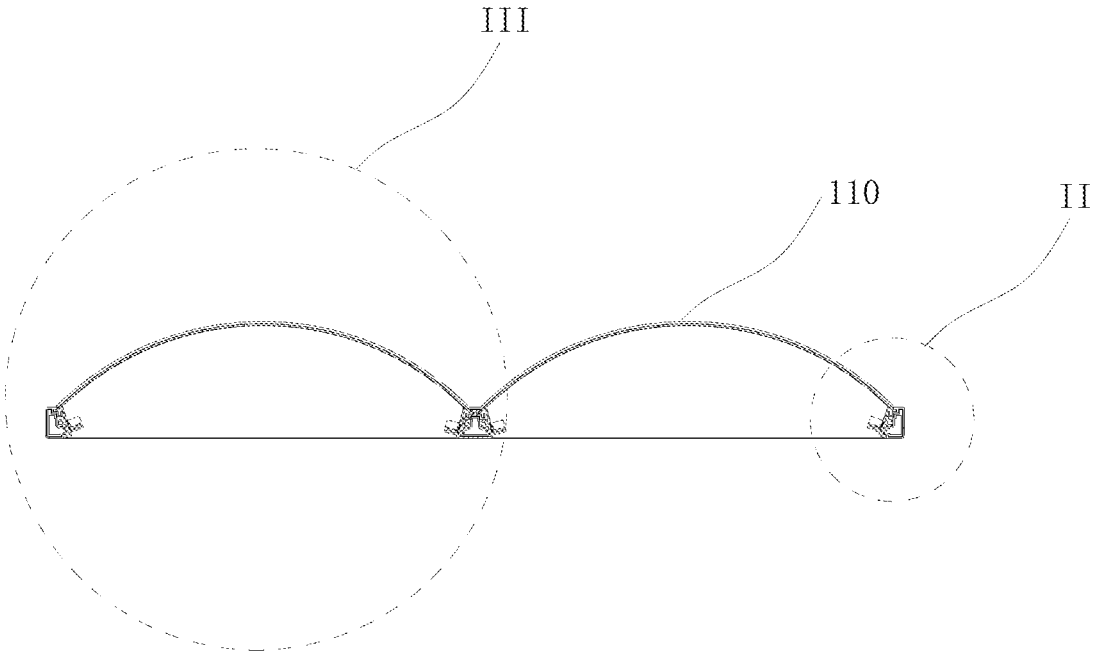
FIG. 3 is a sectional view of the lamp shown in FIG. 1.
Figure 8:
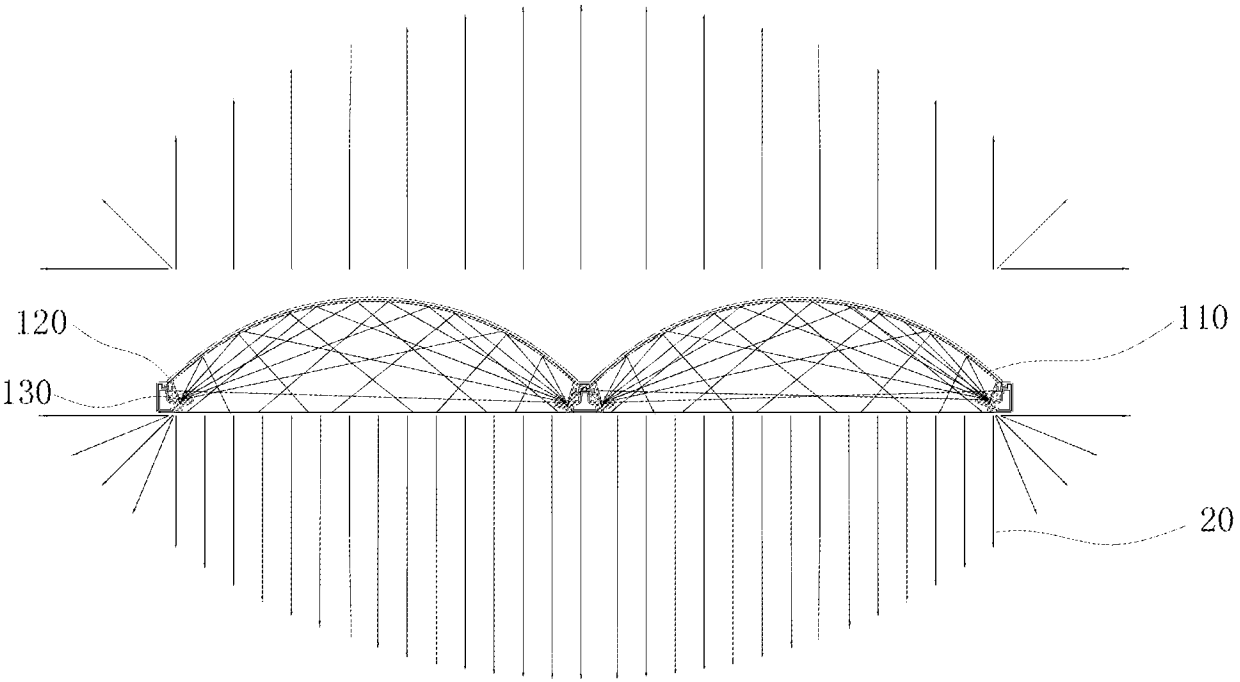
FIG. 8 is a light simulation diagram of the lamp shown in FIG. 3.

Also referring to FIG. 2, FIG. 6, and FIG. 8, the central ray DE is positioned between the reflecting cover 110 and the reflecting element 130. Part of light 20 emitted by the light source assembly 120 is reflected by the reflective wall 132 onto the reflecting surface 130, then reflected by the reflecting surface 112 and emitted from the light exit opening 114. Another part of the light 20 is reflected by the reflecting surface 112 and then emitted from the light exit opening 114.

Specifically, the reflecting element 130 is fixed on the substrate 122. The reflective wall 132 of the reflecting element 130 is disposed proximately to the LED light source 124. The reflective wall 132 is perpendicular to the substrate 122.

Referring to FIG. 2 again, the lamp 100 further has two end caps 140. The two end caps 140 are both fixed to the reflecting cover 110, and are located at both ends of the reflecting surface 112 in the translation direction of the elliptical curve, respectively.

Specifically, each end cap 140 includes a fixing frame 142 and a cover plate 144. The fixing frame 142 is fixed to the reflecting cover 110. The cover plate 144 is fixed to a side of the fixing frame 142 away from the reflecting cover 110.

Further, the fixing frame 142 of the end cap 140 is provided with a mounting slot (now shown in the drawings). The lamp 100 also has an elongate fixing element 150. The elongate fixing element 150 is fixed at the light exit opening 114 of the reflecting cover 110, and extends along the translation direction of the elliptical curve. Two ends of the elongate fixing element 150 are received in the mounting slots of the fixing frames 142 of the two end caps 140, respectively, such that the fixing frames 142 of the end caps 140 are fixed to the elongate fixing element 150.

Specifically, the elongate fixing element 150 is made of aluminum, and the substrate 122 is fixed on the elongate fixing element 150 to facilitate heat dissipation of the LED light source 124.

The aforementioned lamp 100 has at least the following advantages:

(1) By using a diffuse reflecting material to make the reflecting cover 110, the lamp 100 can reduce the intensity of light emitted from the lamp 100, and improve the uniformity of the light output, thereby effectively reducing the glare value of the lamp 100.

(2) By using a foamed material to make the reflecting cover 110, the light emitted by the light source assembly 120 can be reflected by the reflecting cover 110 for a plurality of times, such that light output from the lamp 100 is disordered, the intensity of the light emitted by the lamp 100 is further reduced, and the uniformity of the light output is improved, thereby effectively reducing the glare value of the lamp 100.

(3) The reflecting surface 112 of the reflecting cover 110 of the lamp 100 is configured as the curved surface formed by the translation of the elliptical curve. The light source assembly 120 is fixed to the end portion of the elliptical curve of the reflecting surface 112 of the reflecting cover 110. The angle between the intersection point where the central ray emitted by the light source assembly 120 intersects the reflecting surface 112 and the central ray is 130° to 170°. The reflecting element 130 is fixed to the end portion of the elliptical curve of the reflecting surface 112 of the reflecting cover 110. The reflective wall 132 of the reflecting element 130 is parallel to the central ray emitted by the light source assembly 120. The central ray emitted by the light source assembly 120 is positioned between the reflecting cover 110 and the reflecting element 130. Part of light emitted by the light source assembly 120 is reflected by the reflective wall 132 onto the reflecting surface 112, then reflected by the reflecting surface 112 and emitted from the light exit opening 114. Another part of the light is reflected by the reflecting surface 112 and then emitted from the light exit opening 114. Accordingly, light exiting angles of most light rays can be confined within 120°, the glare value of the indoor lamp 100 can be further reduced, and the uniform glare value can be confined below 19.

(4) Using foamed plastic as the reflecting cover 110 can effectively reduce the weight of the lamp 100.

Figure 9:
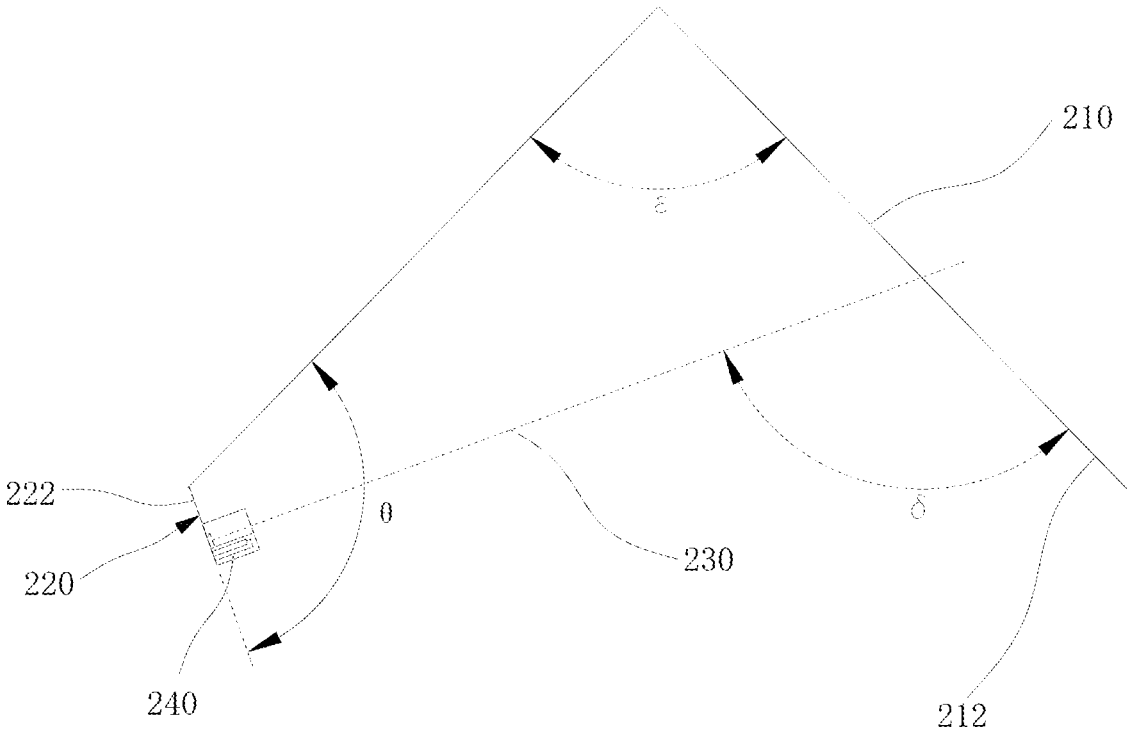
FIG. 9 is a schematic view of a combination of the reflecting cover, the light source assembly, and the reflecting element of a lamp according to another embodiment.

Referring to FIG. 9, the lamp of another embodiment is similar to the structure of the lamp 100, except that a reflecting surface 212 of a reflecting cover 210 of the illustrated embodiment is a curved surface formed by a translation of a polyline and that an angle δ between a central ray 230 emitted by a light source assembly 220 and the reflecting surface 212 is 130° to 170°.

A substrate 222 of the light source assembly 220 is fixed to an end portion of the polyline of the reflecting surface 212 of the reflecting cover 210. Two substrates 222 are fixed to both ends of the polyline of the reflecting surface 212 of the reflecting cover 210, respectively. A longitudinal direction of the substrate 222 is parallel to a translation direction of the polyline. A reflecting element 240 is fixed to the end portion of the polyline of the reflecting surface 212 of the reflecting cover 210, and is fixed to the substrate 222.

Specifically, an angle c of the polyline is 60° to 120°. And, an angle θ between the substrate 222 and the reflecting surface 212 is 100° to 120°. Further, the angle θ between the substrate 222 and the reflecting surface 212 is 114°.

By configuring the reflecting surface 212 of the reflecting cover 210 as the curved surface formed by the translation of the polyline, and configuring the angle between the central ray 230 emitted by the light source assembly 220 and the reflecting surface 212 to be 130° to 170°, and following the arrangement of the reflecting element 130 of the lamp 100, the aforementioned lamp also can confine light exiting angles of most light rays within 120°, thus further reducing the glare value of indoor lamp, and confining the uniform glare value below 19.

Although the respective embodiments have been described one by one, it shall be appreciated that the respective embodiments will not be isolated. Those skilled in the art can apparently appreciate upon reading the disclosure of this application that the respective technical features involved in the respective embodiments can be combined arbitrarily between the respective embodiments as long as they have no collision with each other. Of course, the respective technical features mentioned in the same embodiment can also be combined arbitrarily as long as they have no collision with each other.

Although the invention is illustrated and described herein with reference to specific embodiments, the invention is not intended to be limited to the details shown. Rather, various modifications may be made in the details within the scope and range of equivalents of the claims and without departing from the invention. Therefore, the protection scope of the present invention shall be subject to the protection scope of the appended claims.

What is claimed is:

1. A lamp, comprising:

a reflecting cover made of a diffuse reflecting material, wherein the reflecting cover has a light exit opening, an inner surface of the reflecting cover is a reflecting surface, the reflecting surface is a curved surface formed by a translation of an elliptical curve;

a light source assembly fixed to an end portion of the reflecting surface, wherein an angle between a tangent line at an intersection point where a central ray emitted by the light source assembly intersects the reflecting surface and the central ray is 130° to 170° ; and a reflecting element fixed to the end portion of the reflecting surface, wherein the reflecting element has a reflective wall parallel to the central ray, the central ray is positioned between the reflecting cover and the reflecting element, part of light emitted by the light source assembly is reflected by the reflective wall onto the reflecting surface, then reflected by the reflecting surface and emitted from the light exit opening, another part of the light is reflected by the reflecting surface and then emitted from the light exit opening;

wherein an angle between a tangent line at an end point of the elliptical curve and a connection line between two end points of the elliptical curve is 30° to 60°.

2. The lamp according to claim 1, wherein the diffuse reflecting material is a foamed plastic.

3. The lamp according to claim 2, wherein the diffuse reflecting material is a foamed PET, foamed polycarbonate, or Styrofoam.

4. The lamp according to claim 1, wherein the diffuse reflecting material is an unexpanded polystyrene, unexpanded polycarbonate, unexpanded PET, or unexpanded polytetrafluoroethylene.

5. The lamp according to claim 1, wherein the light source assembly comprises a substrate and an LED light source fixed on the substrate, the substrate is fixed to the end portion of the reflecting surface, an angle between a tangent line at an intersection point where the substrate intersects the reflecting surface and the substrate is 100° to 120° , the substrate is perpendicular to the central ray, the reflecting element is fixed on the substrate, the reflective wall is disposed proximately to the LED light source, and the reflective wall is perpendicular to the substrate.

6. The lamp according to claim 5, wherein the angle between the tangent line at the intersection point where the substrate intersects the reflecting surface and the substrate is 114° .

7. The lamp according to claim 5, wherein each reflecting cover corresponds to two substrates, the two substrates are fixed to both ends of the reflecting surface, respectively, each substrate has a strip shape, a longitudinal direction of the substrate is parallel to a translation direction of the elliptical curve, a plurality of the LED light sources are disposed at intervals along the longitudinal direction of the substrate on each substrate.

8. The lamp according to claim 1, wherein the light transmittance of the reflecting cover is 2% to 3%.

9. The lamp according to claim 1, wherein the specular reflectivity of the reflecting surface is less than 10%.

10. The lamp according to claim 1, wherein the diffuse reflectivity of the reflecting cover is greater than 93%.

11. The lamp according to claim 1, further comprising two end caps, wherein the two end caps are both fixed to the reflecting cover, and are located at both ends of the reflecting surface in a translation direction of the elliptical curve, respectively.

12. The lamp according to claim 11, wherein each end cap comprises a fixing frame and a cover plate, the fixing frame is fixed to the reflecting cover, the cover plate is fixed to a side of the fixing frame away from the reflecting cover.

13. The lamp according to claim 11, wherein each end cap is provided with a mounting slot, the lamp further comprises an elongate fixing element fixed at the light exit opening of the reflecting cover and extends along an extending direction of the curve, two ends of the elongate fixing element are received in the mounting slots of the two end caps, respectively, such that the end caps are fixed to the elongate fixing element.

14. The lamp according to claim 13, wherein the elongate fixing element is made of aluminum, and the substrate is fixed on the elongate fixing element.

15. A lamp, comprising:

a reflecting cover made of a diffuse reflecting material, wherein the reflecting cover has a light exit opening, an inner surface of the reflecting cover is a reflecting surface, the reflecting surface is a curved surface formed by a translation of a polyline;

a light source assembly fixed to an end portion of the reflecting surface, wherein an angle between a central ray emitted by the light source assembly and the reflecting surface is 130° to 170° ; and a reflecting element fixed to the end portion of the reflecting surface, wherein the reflecting element has a reflective wall parallel to the central ray, the central ray is positioned between the reflecting cover and the reflecting element, part of light emitted by the light source assembly is reflected by the reflective wall onto the reflecting surface, then reflected by the reflecting surface and emitted from the light exit opening, another part of the light is reflected by the reflecting surface and then emitted from the light exit opening;

wherein an angle of the polyline is 60° to 120° .

16. The lamp according to claim 15, wherein the light source assembly comprises a substrate and an LED light source fixed on the substrate, an angle between the substrate and the reflecting surface is 100° to 120° , a central ray emitted by the LED light source is perpendicular to the substrate, the reflecting element is fixed on the substrate, the reflective wall is disposed proximately to the LED light source, the reflective wall is perpendicular to the substrate.

17. The lamp according to claim 16, wherein the angle between the substrate and the reflecting surface is 114° .

18. The lamp according to claim 16, wherein each reflecting cover corresponds to two substrates, the two substrates are fixed to both ends of the reflecting surface respectively, each substrate has a strip shape, a longitudinal direction of the substrate is parallel to a translation direction of the polyline, a plurality of the LED light sources are disposed at intervals along the longitudinal direction of the substrate on each substrate.

* * * * *